US006499733B1

(12) United States Patent
Oberhoffner et al.

(10) Patent No.: US 6,499,733 B1
(45) Date of Patent: Dec. 31, 2002

(54) METHOD AND APPARATUS FOR FEEDING SHEET MATERIAL INTO A PRINTER OR COPIER

(75) Inventors: Gerhard Oberhoffner, Munich (DE); Stephan Pilsl, Roehrmoos (DE)

(73) Assignee: Oce Printing Systems GmbH, Poing (DE)

( * ) Notice: Subject to any disclaimer, the term of this patent is extended or adjusted under 35 U.S.C. 154(b) by 0 days.

(21) Appl. No.: 09/284,817

(22) PCT Filed: Oct. 21, 1997

(86) PCT No.: PCT/DE97/02446

§ 371 (c)(1),
(2), (4) Date: Jun. 8, 1999

(87) PCT Pub. No.: WO98/17563

PCT Pub. Date: Apr. 30, 1998

(30) Foreign Application Priority Data

Oct. 22, 1996 (DE) ..... 196 43 614

(51) Int. Cl.[7] ..... B65H 5/00

(52) U.S. Cl. ..... 271/10.03; 271/10.11; 271/111; 271/114; 271/265.02; 271/266; 271/270

(58) Field of Search ..... 271/10.03, 10.02, 271/10.05, 10.07, 10.1, 10.11, 10.13, 10.12, 10.09, 114, 118, 121, 265.01, 265.02, 266, 270, 110, 111

(56) References Cited

U.S. PATENT DOCUMENTS 4,077,620 A * 3/1978 Frank et al. ..... 271/10.03
4,331,328 A * 5/1982 Fasig ..... 271/111
4,451,027 A * 5/1984 Alper ..... 271/270
4,523,832 A * 6/1985 Strutt et al. ..... 271/10.03
4,691,912 A * 9/1987 Gillmann ..... 271/10.03
5,118,089 A * 6/1992 Murata et al. ..... 271/265.02
5,121,915 A * 6/1992 Duncan et al. ..... 271/111
5,205,548 A * 4/1993 Yamada et al. ..... 271/270
5,664,771 A * 9/1997 Nagatani et al. ..... 271/10.13

FOREIGN PATENT DOCUMENTS

DE 26 13 261 3/1976
DE 27 58 007 12/1977
EP 0 167 091 A1 6/1985
EP 0 428 922 A2 11/1990
WO 092016444 A * 10/1992 ..... 271/111

OTHER PUBLICATIONS

Patent Abstracts of Japan Application No. 59090159 filed May 8, 1984.
Patent Abstracts of Japan Application No. 58100188 filed Jun. 7, 1983.

* cited by examiner

*Primary Examiner*—H. Grant Skaggs
(74) *Attorney, Agent, or Firm*—Schiff Hardin & Waite

(57) ABSTRACT

The invention relates to a method of feeding a sheetlike material (50–54) into a printer. An externally located cover sheet (50–54) is removed from a pile of sheets and conveyed towards a section (a10–a12) of the transport path at a transport speed (V0, V1). The lower limit (v0) of the transport speed is the same as or greater than the transport speed (v0) of the sheets (50–54) in section (a1–a12). Conveyance of the sheet (52,54) is delayed until section (a10–a12) has been reached. Identical predetermined spacing (AS) thus occurs between immediately successive transported sheets (52,54).

22 Claims, 3 Drawing Sheets

METHOD AND APPARATUS FOR FEEDING SHEET MATERIAL INTO A PRINTER OR COPIER

The present invention is directed to a method for inputting sheet material into a printer or copier.

BACKGROUND OF THE INVENTION

In known methods for inputting sheet material, a cover sheet respectively lying at the outside is pulled from a stack of sheets in response to a start signal and is transported with a draw-in speed in the direction of a sub-section of the conveying path wherein it is conveyed with an approximately constant, rated conveying speed that corresponds to the draw-in speed.

What is disadvantageous in the known method for inputting sheet material is that the spacing between successive sheets varies. This is to be attributed thereto that the frictional connection between draw-in rollers or, respectively, draw-in belts and the sheets is not 100% assured, so that what is referred to as a micro-slip occurs. The occurring micro-slip is dependent on the paper properties such as, for example, paper thickness and surface roughness. An adjustment of the draw-in force, particularly when pulling the sheets from the stack, leads to a variation of the spacing between successive sheets. When pulling the sheets from the stack, a minimum shift of the sheets neighboring the cover sheet cannot be prevented, so that the exact position of the leading sheet edge in conveying direction is also not known upon draw-in. The result is again that a variation of the spacing between successive sheets occurs.

Over one hundred sheets per minute are printed in high-performance printers. Fluctuations of the sheet spacing between a lower and an upper limit value necessarily lead to a loss of speed when printing compared to a printing with the lower limit value. One must proceed on the basis of the poorest value when specifying the printable number of sheets per time unit. However, the user wants an unchanging printing speed that can be calculated.

European Patent Application EP 0 428 922 A2 discloses an apparatus for document processing. The conveying density is increased in that the spacing between the documents is set with the assistance of a plurality of light barriers for acquiring the position of the documents.

European Patent Application EP 0 167 091 Al discloses a separating mechanism for letter mailings. The spacing between the letter mailings can be set more exactly by taking a prescribed value for the acceleration path upon draw-in into consideration.

German Laid-Open Publication DE 27 58 007 A explains a method for controlling the haul-off event in a means for the output of separated mailings of different length. In order to increase the conveying density given letter mailings of different length, the reference edge for setting the spacing between successive letter mailings is automatically selected.

Therefore, there is a need for a simple method for inputting sheet material that enables an approximately constant sheet spacing between the successively input sheets.

SUMMARY OF THE INVENTION

The aforenoted need is satisfied by the present invention wherein, in a first aspect of the invention is based on the perception that the sheet spacing can be most simply set when drawing the sheets in, since a later correction of a spacing would result in a variation of the topical position of all following sheets. An adjustment of the spacing should be possible both when a rated spacing is downwardly transgressed as well as upwardly transgressed. Given the first aspect of the invention, the transport of the sheet is therefore delayed such that a predetermined, identical spacing between sheets transported immediately following one another derives before the sub-section is reached. The setting of the spacing between the sheets thus ensues upon draw-in of the sheets into the printer. When the draw-in speed is relatively low, then there is hardly any or no delay at all. When the draw-in speed, however, is relatively high, then the delay is longer in order to set the rated spacing. Even when the draw-in speed is lower or equal to the conveying speed, a spacing can be set by delaying the cover sheet upon draw-in when the sheets are pulled from the stack with a spacing relative to one another that is smaller then the predetermined, identical rated spacing.

The delay of the transport is a simple technical measure that, for example, can be implemented by arresting a draw-in means or by decelerating said means.

Given the method according to the first aspect of the invention, the draw-in speed is greater then the conveying speed of the sheets within the sub-section. Delay time for controlling the spacing is gained on the basis of this measure. The spacing when pulling the sheets can thus be increased and the rated spacing can also be exceeded, the pulling thus becoming more reliable since having the sheets run up onto one another is avoided. The range of control of the spacing ultimately increases when increasing the draw-in speed. run up onto one another is avoided. The range of control of the spacing ultimately increases when increasing the draw-in speed.

The number of printed sheets per time unit is not diminished due to the first exemplary embodiment of the invention.

In an exemplary embodiment of the first aspect of the invention, a pre-draw-in position at which the position of the sheet is identified is located between sheet stack and sub-section. What this measure achieves is that the position of the sheet can be employed for further control events. The varying positions of the sheets in the sheet compartment no longer has any influence on a possible variation of the sheet spacing due to the recognition of the exact position of the sheet and measures based thereon.

In a further exemplary embodiment of the first aspect of the invention, the sheet is arrested between sheet stack and sub-section and, after the expiration of a holding time, it is preferably further-conveyed with the draw-in speed. Expediently, the sheet is arrested exactly at the pre-draw-in position. The holding time is dimensioned such that the predetermined, identical spacing between the cover sheet and a previously pulled sheet of the sheet stack—as viewed in conveying direction—is established during transport of the cover sheet up to the sub-section. The holding time can be calculated by simple path/time calculations. The distance between holding position and conveyor means and the draw-in speed are thereby known. The arresting can be realized, for example, via stepping motors and/or couplings.

A second aspect of the invention is directed to a means for drawing in sheet material into a printer or copier, particularly for the implementation of a method described above. The aforementioned technical effects are thus also transferred onto the means for drawing sheet material in according to the second aspect of the invention.

In an exemplary embodiment of the second aspect of the invention, the haul-off roller acting on the cover sheet is employed, the respectively to assure a dependable draw-in, the conveyor means seizes the built sheet before the trailing edge thereof is conveyed past the haul-off roller. What this measure assures is that the haul-off roller that is usually not arranged immediately at the leading edge of the sheet stack can be enabled by the conveyor means when seizing the sheet until the sheet has been completely pulled from the sheet stack. What this prevents is that further sheets are pulled from the sheet stack by the haul-off roller before the cover sheet has been completely pulled from the sheet stack.

In an exemplary embodiment of the second aspect of the invention, the sheet position is acquired with a first light barrier immediately following the draw-in means. Dependent on a signal of the first light barrier that, for example, is generated by the interruption of a light beam by the leading edge of the sheet, the draw-in means is disconnected, so that the sheet rests in the pre-draw-in position. A second light barrier is preferably arranged approximately in the predetermined spacing in conveying direction following the first light barrier. Dependent on a signal of the second light barrier that, for example, is generated by the trailing edge of a sheet that has already been pulled, the control unit again activates the draw-in means. The sheet situated in the pre-draw-in position is thus further-conveyed with the predetermined spacing from the preceding sheet. The draw-in speed can be measured with the assistance of the two light barriers in that the duration of the transport of a sheet between the two light barriers is measured. The point in time at which the sheet is seized by the conveyor means can be acquired from the draw-in speed, so that the draw-in means can be de-activated at this point in time. With the assistance of the draw-in speed, further, one can also calculate when the pulled sheet has a minimum spacing from the stack. When the minimum spacing has been reached, then the control-unit again activates the draw-in means, so that a next sheet is pulled. pulled. A corresponding control unit has been disclosed, for example, by DE 27 58 007 A in the field of mail processing.

The third aspect of the invention is directed to a method for inputting sheet material into a printer or copier that can be utilized in combination with the method according to the first aspect of the invention or separately as well. Multiple sheet pulls are to be prevented by the method according to the third aspect of the invention. Given multiple sheet pulls, at least two sheets at least partially overlapping one another are simultaneously pulled from the sheet stack. The result is an increased consumption of sheets and, potentially, improper prints as well. An improper print is unavoidable when the sheets are printed on both sides. A known measure for preventing multiple sheet pulls is to increase the pressing power of a haul-off means when pulling the sheets from the sheet stack. However, not all multiple or, respectively, double sheet pulls can be prevented with this measure. For example, double sheet pulls derive given poor paper quality or at cut edges that have a burr.

An object of the third aspect of the invention is to prevent multiple draw-ins given input of sheet material into a printer or copier.

This object is achieved by a method based on the consideration that two sheets adhering to one another can be separated from one another by a type of shaking motion. In the third aspect of the invention, the cover sheet, particularly when being pulled from the sheet stack, is therefore transported with a draw-in rate that repeatedly greatly varies. In the extreme case, the cover sheet is pulled in away from the sheet stack by a defined time duration in start/stop mode. Due to the multiple variation of the draw-in speed, sheets also separate from one another that would not separate from one another given a one-time variation of the draw-in speed, for example upon acceleration. A reduction of multiple sheet pulls is thus achieved by a method according to the third aspect of the invention.

When the draw-in speed varies periodically, then the draw-in speed can be varied according to a clock signal with little circuit-oriented or, respectively, software-oriented outlay.

In a further exemplary embodiment of the third aspect of the invention, the draw-in speed is only varied when multiple sheet pulls occur. The variation of the draw-in speed can be activated both by an operator as well as by a sensor unit. The variation of the draw-in speed that leads to increased wear is thus only implemented an increased number of multiple or, respectively, double sheet pulls is to be anticipated due to the paper quality. Moreover, a loss of speed when pulling the sheets in usually occurs due to the varying draw-in speed, this being only justifiable when the risk of multiple sheet pulls is in fact also established.

A fourth aspect of the invention is directed to a means for drawing sheet material into a printer or copier, particularly for the implementation of the method according to the third aspect of the invention. The technical effects cited in the third aspect of the invention are thus also transferred onto the means according to the fourth aspect of the invention.

The invention is described in greater detail below with reference to exemplary embodiments. Thereby shown are:

In an embodiment, the invention provides a method for feeding sheet material into a printer or a copier comprising the steps of pulling an outwardly lying first sheet off of a stack of sheets, transporting the first sheet at a draw-in speed towards a sub-section of a conveying path, conveying the first sheet at a conveying speed through the sub-section, delaying a pulling of an outwardly lying second sheet off of the stack until a predetermined spacing exists between first and second sheets, the draw-in speed being greater than the conveying speed, pulling the second sheet off of the stack of sheets, transporting the second sheet at the draw-in speed towards the sub-section of a conveying path, and conveying the second sheet at the conveying speed through the sub-section.

In an embodiment, the method comprises calculating a point in time at which a leading edge of the first sheet will reach the sub-section, and conveying the first sheet through the sub-section at the conveying speed from said point in time.

In an embodiment, the method comprises identifying the attitude of the first sheet at a pre-draw-in position between the stack of sheets and the sub-section, and identifying the attitude of the second sheet at a pre-draw-in position between the stack of sheets and the sub-section.

In an embodiment, the delaying step further comprises arresting the second sheet the sheet stack and the sub-section until the predetermined spacing exists between the first and second sheets.

In an embodiment, the method comprises the steps of repeating the pulling, delaying, transporting and conveying steps for subsequent outwardly lying sheets.

In an embodiment, the invention comprises an apparatus for feeding sheet material into a printer or copier that comprises at least one sheet compartment for accepting a sheet stack, a draw-in mechanism for pulling outwardly lying sheets, one at a time, from the sheet stack at a draw-in speed, at least one conveyor for receiving sheets, one at a time, from the draw-in mechanism and conveying the sheets at a conveying speed, a control unit for activating and driving the draw-in mechanism, whereby the control unit delays the activation of the draw-in mechanism for successive sheets to provide a predetermined spacing between successive sheets in the conveyor, and wherein the draw-in speed is greater than the conveying speed.

In an embodiment, a first light barrier is disposed between the draw-in mechanism and the conveyor for indicating a first position of the sheet and a second light barrier disposed downstream of the first light barrier and between the first light barrier the conveyor for indicating a second position of the sheet, the first and second light barriers being connected to the control unit and sending signals thereto indicating the time the sheet reaches the first and second positions respectively, the control unit determining the draw-in speed from the signals received from the first and second light barriers.

In an embodiment, the draw-in mechanism comprises a haul-off roller that engages each outwardly lying sheet of the stack of sheets, the draw-in mechanism further comprising a draw-in belt that transports each sheet from the haul-off roller to the conveyor.

In an embodiment, the conveyor is spaced apart from the haul-off roller by a distance that is less than a length of each sheet.

In an embodiment, the control unit deactivates the draw-in mechanism upon receipt of a signal received from the first light barrier.

In an embodiment, the control unit activates the draw-in mechanism upon receipt of a signal from the second light barrier.

In an embodiment, the control unit activates the draw-in mechanism when a sheet reaches a minimum spacing from the stack of sheets.

In an embodiment, a third light barrier disposed in the conveyor and downstream of the second light barrier, the third light barrier for determining the spacing between successive sheets, the third light barrier being connected to the control unit and sending signals thereto, the control unit determining a holding time during which the draw-in mechanism is deactivated, the holding time being dependent on the spacing and on a previously measured draw-in speed, whereby the predetermined spacing exists between successive sheets after expiration of the holding time.

In an embodiment, the method of the invention comprises pulling an outwardly lying first sheet from a stack sheets, transporting the cover sheet at a variable draw-in speed from the stack to a conveyor, and transporting the sheet through the conveyor at a constant conveying speed.

In an embodiment, the draw-in speed is varied periodically.

In an embodiment, the draw-in speed is varied when multiple sheet pulls occur.

In an embodiment, the apparatus of the present invention provides an apparatus for feeding sheet material into a printer or copier that comprises at least one sheet compartment for receiving a sheet stack, a draw-in mechanism for pulling an outwardly lying first sheet from the stack at a draw-in speed, at least one conveyor for conveying the sheet at a conveying speed, and a control unit for controlling the draw-in mechanism wherein the control unit varies the draw-in speed when the pulling the first sheet off of the stack.

Other objects and advantages of the present invention will become apparent from reading the following detailed description and appended claims, and upon reference to the accompanying drawings.

BRIEF DESCRIPTION OF THE DRAWINGS

FIG. 3 is a path/time diagram for illustrating a spacing control with vibratory draw-in.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
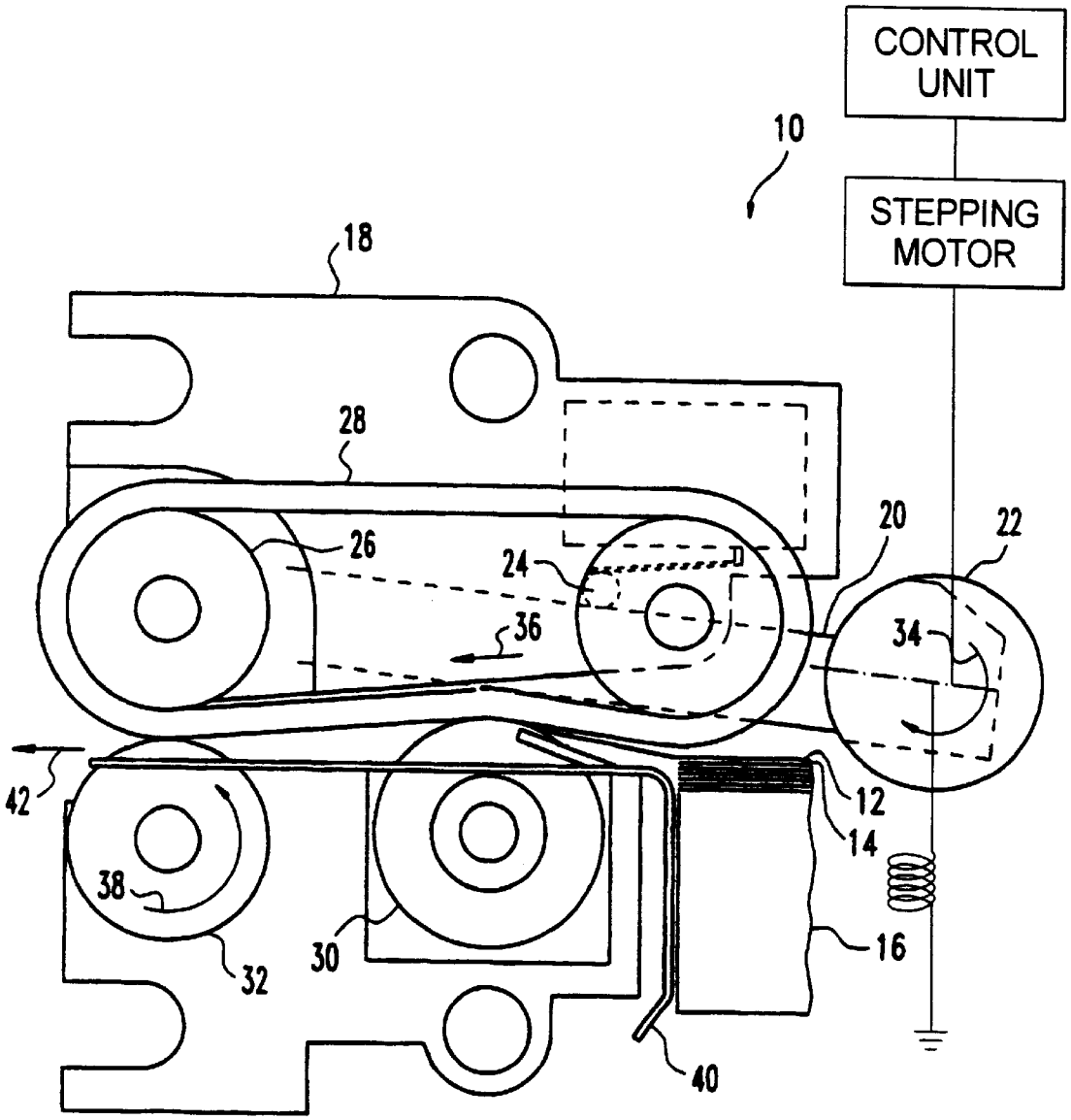
FIG. 1 is a schematic illustration of a draw-in means for pulling sheet material into a printer.

FIG. 1 shows the side view of a draw-in means 10 for pulling paper sheets 12, 14 in from a sheet stack 16 that is held in a sheet compartment. The component parts of the draw-in means 10 are carried by a frame 18 to which a lever 20 pivotable around its one end is also secured. A haul-off roller 22 is arranged at the other end of the lever 20. This roller 22 being pressed against the sheet stack 16 with the assistance of a spring (not shown). A conveyor belt 28 is stretched between two conveyor rollers 24, 26 rotatably seated at the frame 18. A non-rotatable stop roller 30 at which the conveyor belt is conducted past at an approximate angle of 170° lies directly against the conveyor belt 28 close to the conveyor roller 24. A counter-roller 32 is in contact with the conveyor belt 28 in the area of the conveyor roller 26. A stepping motor (not shown) is drive-connected to the haul-off roller 22, the conveyor roller 24 and the counter-roller 32 via a coupling means, so that the haul-off roller 22 rotates in the direction of an arrow 34 and the counter-roller 32 rotates in the direction of a rotational arrow 38. The surfaces of the haul-off roller 22, of the conveyor belt 28 and of the counter-roller 32 consists of a rubberized material having a very high coefficient of friction. When the draw-in means 10 is activated, the uppermost sheet 12 of the sheet stack 16 is thus supplied to the conveyor belt 28 by the haul-off roller 22. A guide plate 40 assures that only an extremely slight number of sheets 12, 14 of the sheet stack 16 can simultaneously proceed up to the stop roller 30.

As soon as the cover sheet 12 is seized by the conveyor belt 28, it moves toward the counter-roller 32 in conveying direction 36. Supported by the counter-roller 32, the respectively conveyed sheet is transported from the draw-in means 10 in the direction of an arrow 42 to a further conveyor means that transports the pulled sheets to a printing unit and past a fixing station to a sheet output.

Figure 2:
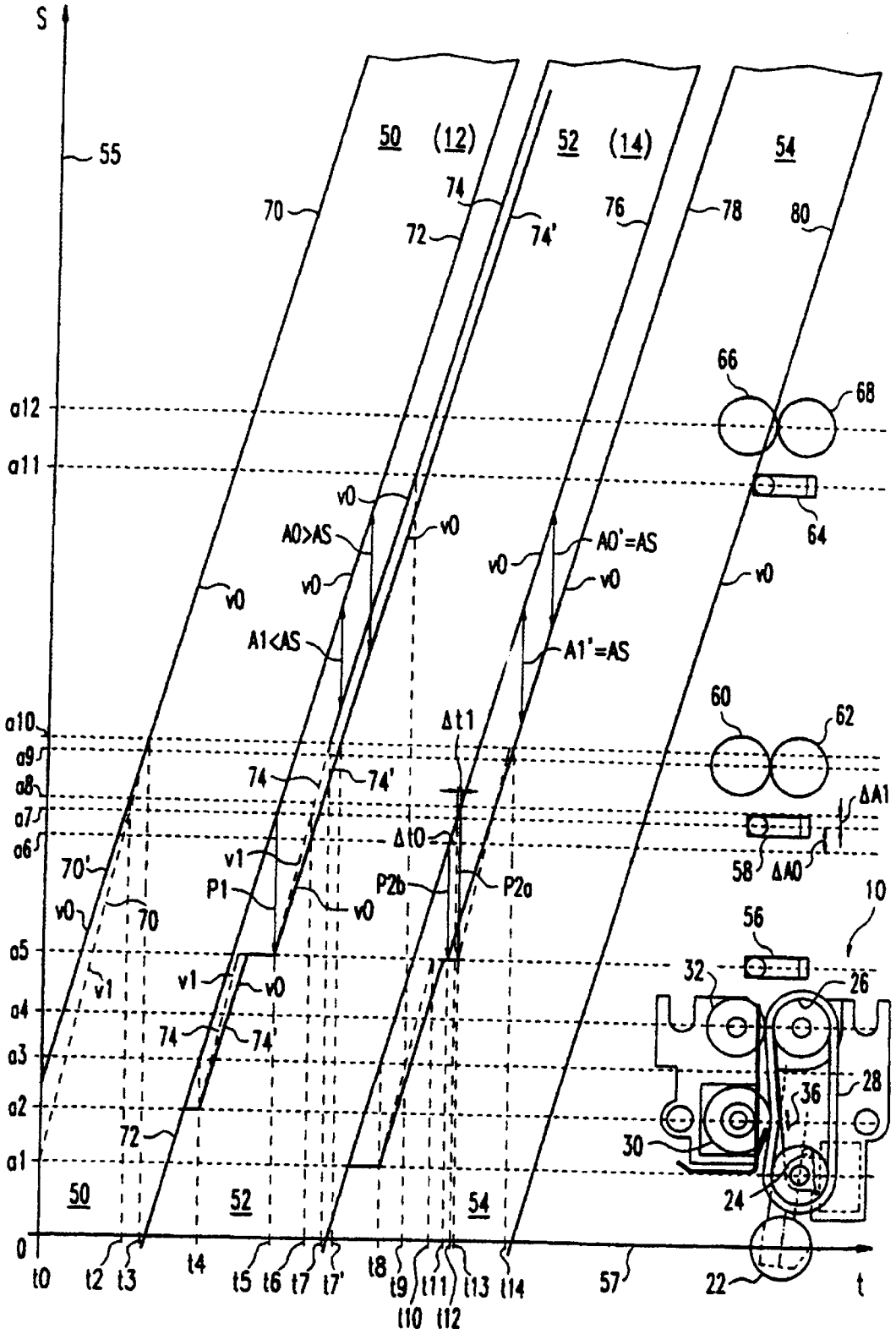
FIG. 2 is a path/time diagram for illustrating a spacing control.

FIG. 2 shows a path/time diagram for three pulled sheets 50, 52 and 54, whereby the conveying path s is recorded on the ordinate axis 55 and the time t is recorded on the abscissa axis 57. The path/time diagram is also overlaid on an illustration of the draw-in means 10 according to FIG. 1. The haul-off roller 22 is located in the zero point of the ordinate axis 55 at the beginning of the conveying path s of the sheets.

Positions a1 through a12 that are arranged in this sequence along the conveying path can be distinguished in conveying direction 36 of a sheet 50, 52 or, respectively, 54. The conveyor roller 24 is located at the position a1, and the stop roller 30 is located at the position a2. The difference of a position a3 and the position a2 identifies a minimum spacing between two successive sheets in the draw-in means 10, whereby the minimum spacing is selected such that a running of the following sheet onto the proceeding sheet is precluded. The conveyor roller 26 and the counter-roller 32 are arranged at a spacing a4.

A first light barrier 56 is arranged such in a position a5 that a light beam is interrupted by a sheet that is conveyed past. A position a6 is located between the light barrier 56 and a second light barrier 58 for acquiring the sheet position at a position a7. A position a8 is located between the light barrier 58 and a first conveyor roller pair of conveyor rollers 60 and 62 of a conveyor means of the printer located at a position a9. The significance of the positions a6, a8 as well as of a position a10 immediately behind the conveyor rollers 60, 62 as viewed in conveying direction shall be explained later.

A third light barrier 64 is located at a position al1 preceding—as viewed in conveying direction, a second conveyor roller pair of conveyor rollers 66, 68 at a position a12.

The sheet 50 is drawn in beginning at a point in time tO by activating the draw-in means 10. The leading edge 70 of the sheet 50 moves from the position a1 with a draw-in speed v1—indicated by a broken line 70. The sheet 50 is the first sheet pulled in from a group of sheets 50, 52, 54, etc., to be pulled in and is therefore conveyed without stopping. The draw-in speed v1 is measured between the light barriers 56 and 58.

As soon as the leading edge 70 is located at the position a10, it can be assumed that the conveyor rollers 60, 62 have reliably seized the sheet 50. Due to the conveyor rollers 60, 62, the leading edge 70 is further-conveyed with a conveying speed v0 that is lower then the draw-in speed v1. The conveying speed v0 of the leading edge 70 and, thus, of the sheet 50 as well is illustrated with a solid line. Where the leading edge 70 passes the light barrier 58 at a point in time t2, then a point in time t3 at which the leading edge 70 reaches the position a10 can be calculated according to the following equation:

$$t3=t2+(a10-a7)/v1 \quad (1)$$

At point in time t3, the trailing edge of the sheet 50 is still located proceeding the draw-in roller 22 as viewed in conveying direction 36. The draw-in means 10 is de-activated at point-in-time t3, i.e. the stepping motor no longer drives the draw-in roller 22, the conveyor belt 28 and the counter-roller 32. The sheet 50 is thus conveyed only by the conveyor rollers 60, 62 with the conveying speed v0, so that the trailing edge 72 of the sheet 50 must also have the conveying speed v0.

The draw-in means 10 is only re-activated when the trailing edge 72 of the sheet 50 reaches the position a3 at a point-in-time t4, that is calculated according to the following equation:

$$t4=t3+(L-(a10-a3))/v0 \quad (2)$$

whereby L is the length of the sheets 50, 52 or, respectively, 54 in conveying direction 36.

At point-in-time t4, the leading edge 74 of the next sheet 52 begins to move with the draw-in speed v1. The exact starting position of the leading edge 74 cannot be exactly predicted since it is located between the positions a1 and a2. In the worst case, the starting position of the leading edge 74, however, is the position a2, as shown in FIG. 2. The safety margin a3–a2, however, is selected such that the leading edge 74 having the maximum draw-in speed v1 cannot overtake the trailing edge 72 of the preceding sheet 50 before the position a5. At the position a5, i.e. when the light barrier 56 is reached, the sheet 52 is then stopped in a pre-draw-in position. The arresting in the pre-draw-in position always ensues when a preceding sheet is located in the region of the light barrier 58.

As soon as the trailing edge 72 passes the light barrier 58, the draw-in means 10 is again activated, so that the leading edge 74 moves farther with the draw-in speed v1 at a point-in-time t5 (see arrow P1). At a point-in-time t6, the leading edge 74 reaches the light barrier 58. According to equation (1), a point-in-time t7 can be calculated when t2 in equation (1) is replaced by t6 and t3 is replaced by t7. At point-in-time t7, the draw-in means 10 is again disconnected. The leading edge 74 is seized by the conveyor rollers 60, 62 and is conveyed with the conveying speed v0. A spacing a1 between the trailing edge 72 and the leading edge 74 then always remains unvaried since both edges move with the same conveying speed v0. The spacing A1 is smaller then a rated spacing AS. The spacing A1 is measured with the light barrier 64 and is known at a point-in-time t9 at which the leading edge 74 reaches the position al1 of the light barrier 64.

At a point-in-time t8 that lies somewhat preceding the point-in-time t9, the draw-in means 10 is again activated, since, according to equation (2), the trailing edge 74 of the sheet 52 has reached the position a3. t3 in the equation (2) is thereby to be replaced by t7 and t4 is to be replaced by t8. The leading edge 78 of the sheet 74 moves with the draw-in speed v1 up to the pre-draw-in position a5 at the light barrier 56. Accordingly, the draw-in means 10 is disconnected at a point-in-time t10.

The activation of the draw-in means 10, however, now ensues not at point-in-time t12 at which the trailing edge 76 passes the light barrier 58 but with a delay Δt1 with respect to the point-in-time t12, beginning at a point-in-time t13 (see arrow P2*a*) that is calculated according to the following equation:

$$\Delta t1 = \frac{AS - A1}{v1} = \frac{\Delta A1}{v1} \quad (3)$$

whereby ΔA1 is the spacing by which the spacing A1 increases.

When the leading edge 78 reaches the position a10 at a point-in-time t14, then the draw-in means 10 is again disconnected. A spacing A1' between the trailing edge 76 and the leading edge 78 now exactly corresponds to the rated spacing AS. The rated spacing AS is also exactly set between further sheets.

When the draw-in speed v1 is modified to a value v0 that corresponds to the conveying speed v0, the control of the spacings between the sheets 50, 52, and 54 ensues in a similar fashion. For example, a variation of the draw-in speed occurs when a sheet stack having sheets of a different quality is inserted, by increasing the pressing power of the draw-in belt 28 at the stop roller 30.

At point-in-time tO, the sheet 50 is now started from the position a2, whereby the leading edge 70' moves with the draw-in speed v0. This speed is acquired between the light barrier 56 and the light barrier 58 and replaces the value for the draw-in speed v1 in equations (1) through (3). Otherwise, the transport of the sheet 50 ensues exactly as described above, whereby the control events cited there are also implemented.

At point-in-time t4, the sheet 52 is started with the leading edge at the position a2 and the draw-in speed v0. The leading edge 74' moves up to the position a5 at which the light barrier 56 is located, i.e. up to the pre-draw-in position. The trailing edge 72 of the sheet 50 passes the light barrier 58 at point-in-time t5, so that the draw-in means 10 is again activated at this point-in-time and, thus, the sheet 52 continues to move with the draw-in speed v0 (see arrow P1). At a point-in-time t7', the leading edge 74' reaches the position a10, whereupon the draw-in means 10 is deactivated. The light barrier 64 identifies a spacing A0 between the trailing edge 72 and the leading edge 74'. This spacing A0 is greater then the rated spacing AS. In a way analogous to equation (3), a delay time Δt0 is then calculated instead of the delay time Δt1, this delay time Δt0 having a negative operational sign. The spacing A0 is thereby employed in equation (3) instead of A1 and the new draw-in speed v0 is employed instead of v1. The negative operational sign of Δt0 means that the sheets must be started from the pre-draw-in position before the trailing edge, for example 76, of the preceding sheet passes the position a7 at the light barrier 58. As a result of the earlier start from the pre-draw-in position a5, a change in spacing ΔA0 derives, this leading to a spacing A0' between the sheet 52 and the sheet 54 and being dimensioned such that the spacing A0' is equal to the rated spacing AS.

The earlier start (see arrow P2*b*) can be implemented with the assistance of the light barrier 56 in that a point-in-time t10 is calculated proceeding from a point-in-time t* at which the trailing edge 76 passes the light barrier 56:

$$t10 = t^* + \frac{((a7 - a5) - |\Delta A0|)}{v0} \tag{4}$$

whereby the vertical strokes identify the amount operation.

When the draw-in speed lies between a minimum value v0 and its maximum value v1, then the rated spacing AS between the sheets can be set in an analogous way with the assistance of the control described on the basis of FIG. 2.

A constant spacing at least between the sheets following the first sheet is of special significance when the sheets are drawn into a high-performance printer in groups of, for example, respectively six sheets, this high-performance printer having two printing units and conveying paths between these two printing units crossing therein. The conveying paths can be designed extremely short when the overall length of a group of sheets can be defined within narrow limits. Short conveying paths result in a compact structure of the high-performance printer.

Figure 3:
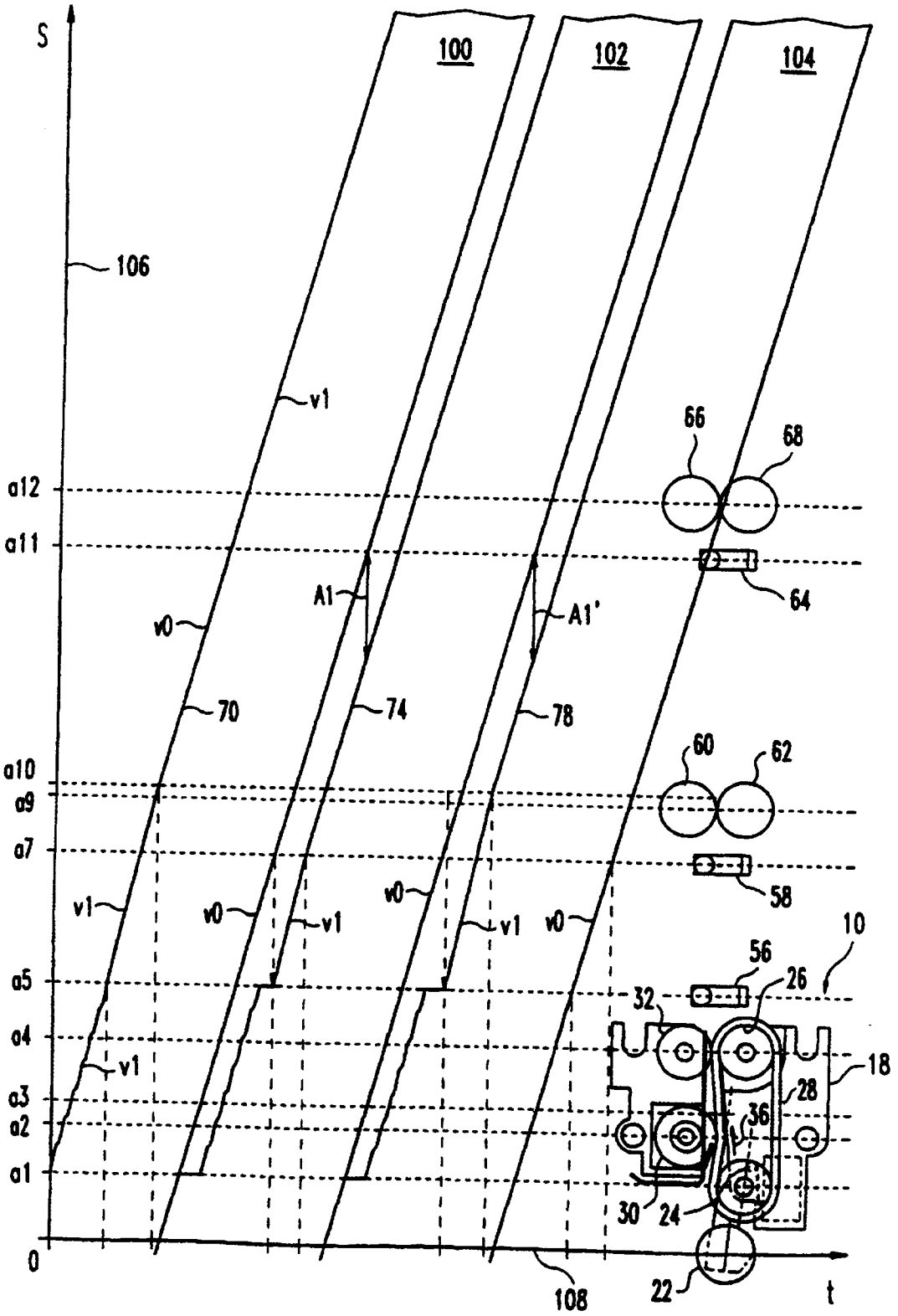

FIG. 3 shows a path/time diagram for three pulled sheets 100, 102 and 104, whereby the conveying paths s is recorded on the ordinate axis 106 and the time t is recorded on the abscissa axis 108. The path/time diagram is also overlaid on an illustration of the draw-in means 10 according to FIG. 1. The positions a1 through a12 explained on the basis of FIG. 2 and the reference characters 56–78 explained therein are also entered in FIG. 3. The control of the sheet spacing between the sheets 100, 102 and 104 ensues analogous to the control of the sheet spacing of the sheets 50, 52 and 54 according to FIG. 2 given the draw-in speed v1.

Differing from FIG. 2, a vibratory draw-in is employed in FIG. 3 when drawing a sheet in, during which the leading 70, 74 or, respectively, 78 moves between the positions a1 and a5, i.e. between the conveyor roller 24 and the light barrier 56. When the leading edge of the sheet to be pulled in is located between the position a1 and the position a2 at the beginning of the draw-in event, then the vibratory draw-in ensues by a correspondingly shortened path beginning from the quiescent position of respective leading edge.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

During the transport of the sheet 100 from the position a1 to position a5, the draw-in means 10 is activated seven times and deactivated six times. The deactivation times are thereby only about half as long as the times wherein the draw-in means 10 is activated. When the leading edge of a sheet reaches the position a5 at the light barrier 56, the draw-in means 10 is again activated at the first sheet 100, so that the sheet 100 does not stop in the pre-draw-in position. In the case of the following sheets 102, 104, the draw-in means 10 is deactivated as soon as the leading edge 74, 78 is located in the pre-draw-in position, so that the sheet 102 or, respectively 104 is arrested in the pre-draw-in position.

In another exemplary embodiment, the on-time of the draw-in means respectively amounts to 60 ms and the off-time respectively amounts to ms during which the leading edge of a sheet 100, 102 or, respectively, 104 is located between the positions a1 and a5.

What is claimed is:

1. A method for feeding sheet material into a printer or copier, the method comprising the following steps:

pulling an outwardly lying first sheet off of a stack of sheets;

transporting the first sheet at a draw-in speed towards a sub-section of a conveying path;

conveying the first sheet at a conveying speed through the sub-section; p1 delaying a pulling of an outwardly lying second sheet off of the stack until a predetermined spacing exists between first and second sheets;

pulling the second sheet off of the stack of sheets when said predetermined spacing has been achieved;

transporting the second sheet at the draw-in speed towards the sub-section of a conveying path;

conveying the second sheet at the conveying speed through the sub-section; and providing said predetermined spacing between said first and second sheets at a plurality of locations along said conveying path.

2. The method of claim 1 further comprising the following steps:

calculating a point in time at which a leading edge of the first sheet will reach the sub-section; and conveying the first sheet through the sub-section at the conveying speed from said point in time.

3. The method of claim 1, further comprising the following steps:

identifying the position of the first sheet at a pre-draw-in position between the stack of sheets and the sub-section; and identifying the position of the second sheet at a pre-draw-in position between the stack of sheets and the sub-section.

4. The method of claim 1, wherein the delaying step further comprises arresting the second sheet between the sheet stack and the sub-section until the predetermined spacing exists between the first and second sheets.

5. The method of claim 1, further comprising the steps of:

repeating the pulling, delaying, transporting and conveying steps for subsequent outwardly lying sheets relative to the sheet stack.

6. An apparatus for feeding sheet material into a printer or copier, the apparatus comprising:

at least one sheet compartment for accepting a sheet stack, a draw-in mechanism for pulling outwardly lying sheets, one at a time, from the sheet stack at a draw-in speed, at least one conveyor for receiving sheets, one at a time, from the draw-in mechanism and conveying the sheets at a conveying speed, a control unit for activating and driving the draw-in mechanism, the control unit being operable to delay the activation of the draw-in mechanism for successive sheets, said control unit being operable to provide a predetermined spacing between successive sheets at a plurality of locations in the conveyor, and wherein the draw-in speed is greater than the conveying speed.

7. The apparatus of claim 6 further comprising a first light barrier disposed between the draw-in mechanism and the conveyor for indicating a first position of the sheet and a second light barrier disposed downstream of the first light barrier and between the first light barrier the conveyor for indicating a second position of the sheet, the first and second light barriers being connected to the control unit and sending signals thereto indicating the time the sheet reaches the first and second positions respectively, the control unit determining the draw-in speed from the signals received from the first and second light barriers.

8. The apparatus of claim 7 wherein the control unit deactivates the draw-in mechanism upon receipt of a signal received from the first light barrier.

9. The apparatus of claim 6 wherein the draw-in mechanism comprises a haul-off roller that engages each outwardly lying sheet of the stack of sheets, the draw-in mechanism further comprising a draw-in belt that transports each sheet from the haul-off roller to the conveyor.

10. The apparatus of claim 6 wherein the conveyor is spaced apart from the haul-off roller by a distance that is less than a length of each sheet.

11. The apparatus of claim 6 wherein the control unit activates the draw-in mechanism upon receipt of a signal from the second light barrier.

12. The apparatus of claim 6 wherein the control unit activates the draw-in mechanism when a sheet reaches a minimum spacing from the stack of sheets.

13. An apparatus for feeding sheet material into a printer or copier, the apparatus comprising:

at least one sheet compartment for accepting a sheet stack, a draw-in mechanism for pulling outwardly lying sheets, one at a time, from the sheet stack at a draw-in speed, at least one conveyor for receiving sheets, one at a time, from the draw-in mechanism and conveying the sheets at a conveying speed, a control unit for activating and driving the draw-in mechanism, whereby the control unit delays the activation of the draw-in mechanism for successive sheets to provide a predetermined spacing between successive sheets in the conveyor, and wherein the draw-in speed is greater than the conveying speed, a first light barrier disposed between the draw-in mechanism and the conveyor for indicating a first position of the sheet and a second light barrier disposed downstream of the first light barrier and between the first light barrier the conveyor for indicating a second position of the sheet, the first and second light barriers being connected to the control unit and sending signals thereto indicating the time the sheet reaches the first and second positions respectively, the control unit determining the draw-in speed from the signals received from the first and second light barriers a third light barrier disposed -in a conveyor path of the conveyor and downstream of the second light barrier, the third light barrier for determining the spacing between successive sheets, the third light barrier being connected to the control unit and sending signals thereto, the control unit determining a holding time during which the draw-in mechanism is deactivated, the holding time being dependent on the spacing and on a previously measured draw-in speed, whereby the predetermined spacing exists between successive sheets after expiration of the holding time.

14. A method for feeding sheet material into a printer or copier, the method comprising the following steps:

pulling an outwardly lying first sheet from a stack of sheets;

transporting the first sheet at a varying draw-in speed from the stack to a conveyor, said varying draw-in speed varying by a plurality of alternately increasing and decreasing sheet transport speeds; and transporting the first sheet through the conveyor at a constant conveying speed.

15. The method of claim 14 wherein the draw-in speed is varied periodically.

16. The method of claim 14 wherein the draw-in speed is varied when multiple sheets pulls occur.

17. An apparatus for feeding sheet material into a printer or copier, the apparatus comprising:

at least one sheet compartment for receiving a sheet stack;

a draw-in mechanism for pulling an outwardly lying first sheet from the stack at a draw-in speed;

at least one conveyor for conveying the sheet at a conveying speed; and a control unit for controlling the draw-in mechanism wherein the control unit varies the draw-in speed when pulling the first sheet off the stack, said control unit providing a predetermined spacing between successive sheets at a plurality of locations in a conveying path.

18. A method for inputting sheet material into a printer or copier, comprising the following steps:

removing a first sheet lying at an outside of a sheet stack and transporting said first sheet via a first sub-section to a second sub-section of a transport path;

taking a second sheet following the first sheet from the sheet stack;

transporting the second sheet in the first sub-section in the direction of the second sub-section, said second sheet being transported with a draw-in velocity;

delaying transport of the second sheet until the second sub-section is reached by said first sheet such that a predetermined rated spacing exactly derives for the spacing of said second sheet from the first sheet in the second sub-section; and transporting both sheets with the same transport velocity in the second sub-section.

19. A method as claimed in claim 18, wherein a spacing between the first sheet and the second sheet in the first sub-section is smaller than the predetermined rated spacing between the first sheet and the second sheet in the second sub-section.

20. A method as claimed in claim 18, wherein the draw-in velocity in the first sub-section is higher than the transport velocity of the sheets within the second sub-section.

21. A method as claimed in claim 18, wherein the draw-in velocity is only not greater than the transport velocity.

22. A method as claimed in claim 18, further comprising the step of:

taking the first and second sheets from the sheet stack with a spacing from one another that is less than the predetermined rated spacing.

* * * * *